US007365696B1

(12) United States Patent
Smeltzer

(10) Patent No.: US 7,365,696 B1
(45) Date of Patent: Apr. 29, 2008

(54) MULTITRANSMITTER RF ROTARY JOINT FREE WEATHER RADAR SYSTEM

(75) Inventor: Rick Smeltzer, Worthington, OH (US)

(73) Assignee: Weather Detection Systems, Inc., Worthington, OH (US)

( * ) Notice: Subject to any disclaimer, the term of this patent is extended or adjusted under 35 U.S.C. 154(b) by 56 days.

(21) Appl. No.: 11/543,547

(22) Filed: Oct. 4, 2006

(51) Int. Cl.
*H01Q 3/00* (2006.01)

(52) U.S. Cl. ..... 343/757; 343/762; 342/359

(58) Field of Classification Search ..... 343/757, 343/761, 762, 763, 765, 766; 342/359
See application file for complete search history.

(56) References Cited

U.S. PATENT DOCUMENTS

| | | | | |
|---|---|---|---|---|
| 4,053,882 | A | 10/1977 | Van Etten | |
| 4,743,910 | A | 5/1988 | Hill et al. | |
| 4,800,389 | A | 1/1989 | Reger et al. | |
| 5,032,843 | A | 7/1991 | Zilliox | |
| H966 | H | 9/1991 | Waters et al. | |
| 5,663,730 | A | 9/1997 | Isaksen | |
| 5,825,333 | A | 10/1998 | Kudoh et al. | |
| 5,835,057 | A * | 11/1998 | van Heyningen | 342/359 |
| 6,078,281 | A | 6/2000 | Milkovich et al. | |
| 6,107,976 | A | 8/2000 | Purinton | |
| 6,215,443 | B1 | 4/2001 | Komatsu et al. | |
| 6,246,378 | B1 * | 6/2001 | Benjauthrit | 343/839 |
| 6,323,825 | B1 | 11/2001 | Zidek et al. | |
| 6,433,736 | B1 * | 8/2002 | Timothy et al. | 342/359 |
| 6,501,417 | B1 | 12/2002 | Bowlds | |
| 6,538,612 | B1 * | 3/2003 | King | 343/757 |
| 6,552,626 | B2 | 4/2003 | Sharpe et al. | |
| 6,710,749 | B2 * | 3/2004 | King | 343/757 |
| 6,795,031 | B1 | 9/2004 | Walker et al. | |
| 6,803,875 | B1 | 10/2004 | Alford et al. | |
| 6,859,163 | B2 | 2/2005 | Alford et al. | |
| 6,963,315 | B2 | 11/2005 | Gierow et al. | |
| 7,042,409 | B2 * | 5/2006 | Desargant et al. | 343/765 |
| 7,049,997 | B2 | 5/2006 | Alford et al. | |
| 2004/0056791 | A1 | 3/2004 | Alford et al. | |
| 2005/0093734 | A1 | 5/2005 | Alford et al. | |

OTHER PUBLICATIONS

Larry Carey, Review of "Observing Precipitation throught Dual-Polarization Radar Measurements" by P.H. Herzegh and A.R. Jameson, 1992. Bull. Amer. Meteor. Soc., 73, 1365-1374.

Dual Polarization Radars, accessed on Oct. 4, 2006 at http://www.atmos.uiuc.edu/courses/atmos410-fa04/polarimetric%20radar%20bob.ppt#1.

* cited by examiner

*Primary Examiner*—Hoanganh Le
(74) *Attorney, Agent, or Firm*—Gallagher & Dawsey Co, LPA; Michael J. Gallagher; David J. Dawsey

(57) ABSTRACT

A multitransmitter RF rotary joint free weather radar system is used to transmit two transmitted waves toward an object and to receive two reflected waves from the object. The system incorporates an antenna pedestal having a platform support and a platform. The platform support is attached to a base. The platform is rotatably coupled to the platform support. A reflector is in electromagnetic communication with a coherent transmitter subsystem, a first channel subsystem, a second channel subsystem, and an analyzer subsystem. The subsystems rotate with the platform and reflector. RF rotary joints are not utilized. The coherent transmitter subsystem generates radio signals that are modulated by the two subsystems to create the two transmitted waves. Two receivers process the reflected waves. The analyzer subsystem is in wireless communication with a remote computer.

23 Claims, 8 Drawing Sheets

MULTITRANSMITTER RF ROTARY JOINT FREE WEATHER RADAR SYSTEM

TECHNICAL FIELD

The instant invention relates generally to weather radar systems, and, more particularly, relates to a weather radar system utilizing multiple transmitters and receivers which rotate with an antenna and therefore the system operates without radio frequency (RF) rotary joints.

BACKGROUND OF THE INVENTION

The majority of weather radar systems are generally comprised of multiple components, such as a transmitter, a rotating antenna which includes a reflector, a waveguide, a receiver, multiple RF rotary joints, and associated electronics. In the case of weather radar, electromagnetic energy, or electromagnetic waves, are used to detect, identify, track, and study hydrometeors (i.e. rain, ice crystals, hail, graupel, and snow) and other weather formations. The various components cooperate so that electromagnetic waves can be produced, transmitted, detected and processed.

The transmitter, which generates the desired electromagnetic wave, is typically located on the ground. Most often, the transmitter is located at the base of a tower structure. The tower structure elevates the antenna for the purpose of reducing interference with ground clutter and improving an effective operational range of a system. Antennas often incorporate reflectors for focusing transmitted waves and for amplifying received waves that have reflected from objects. Antennas also incorporate orthomode feed horns for directing and receiving electromagnetic waves from the reflector. Generally, the reflector and the orthomode feed horn rotate to provide a panoramic view of the horizon. Elevating and rotating the reflector creates a number of problems in the prior art.

First, to transport the electromagnetic waves from the transmitter to the reflector, waveguides are installed. Since the waveguides must reach from the transmitter to the reflector, they may be hundreds of feet long. Besides being expensive, long runs of waveguides attenuate electromagnetic waves as they travel from the transmitter to the orthomode feed horn and from the orthomode feed horn to the receiver. Even small losses per foot of waveguide create large cumulative losses over the length of the waveguide. To compensate for these losses, the transmitters must have peak powers that exceed the system's targeted transmission power. Therefore, in addition to the capital cost incurred to install the waveguide, excess capital is spent to oversize the transmitter.

Waveguides are also problematic from an operational expense viewpoint. Since the waveguide extends from the orthomode feed horn to the ground based transmitter, a portion of the waveguide may be exposed to moisture in the environment. As with many other types of electronics, waveguides are sensitive to moisture. Minute quantities of moisture may have deleterious effects on the electromagnetic waves as they pass through the waveguide. Various waveguide installation designs attempt to minimize the effects of water on waveguide operation. For instance, some designs use a purge gas, such as dry air or nitrogen, to pressurize the waveguide, thus inhibiting penetration of moisture into the waveguide. Continuous flow of the purge gas is usually required since small gas leaks develop over time. Thus, in addition to being expensive to purchase, waveguides are expensive to operate.

Second, since the antenna rotates, and the transmitter and waveguides do not, connectivity between the waveguide and the rotating antenna is critical to system performance. RF rotary joints are commonly used to transfer the electromagnetic energy between the stationary guide and the rotating reflector. To complicate the connectivity problems, the reflector may have azimuth and elevation movement. In other words, the antenna moves about two axes. Therefore, two RF rotary joints per waveguide must be used, or alternatively a special RF rotary joint having two axes of movement may be installed. In most cases, the drawbacks to RF rotary joints include (a) significant power loss and phase distortion as the electromagnetic wave transitions through the RF rotary joint, (b) they are likely points of water intrusion, and (c) they are high wear components. In summary, like waveguides, RF rotary joints are expensive to install and reduce the performance of the radar system.

Therefore, what is missing in the art is a radar system lacking RF rotary joints and long runs of waveguide between the transmitter and the orthomode feed horn. Furthermore, what is missing is a dual-polarization simultaneous-emission weather radar system having low capital and operating cost with superb performance.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

In one embodiment of the multitransmitter RF rotary joint free weather radar system, the system is mounted on a base. The system is designed to emit a first channel first transmitted wave and a second channel first transmitted wave, towards an object. For example, the objects may be hydrometeors (i.e. rain drops, ice crystals, hail, graupel, and snow). The system receives a first channel first reflected wave and a second channel first reflected wave. Generally, the system is a weather radar system where the first and second channel first transmitted waves may have two independent frequencies, polarizations, phases, and angles of polarization. In addition, the system has frequency, phase, polarization, and angle of polarization agility between any two successive transmissions.

In one embodiment of the present invention, an antenna pedestal is attached to the base, possibly within a radome. The antenna pedestal has a platform support and a platform. The platform and a reflector are rotatably coupled to the platform support. An azimuth axis of rotation extends through the platform support. An elevation axis of rotation extends from the platform. The platform is rotatably coupled to the platform support, which allows the platform to rotate around the azimuth axis of rotation. An azimuth control system orients the platform and reflector around the azimuth axis of rotation. In one embodiment an elevation control system orients the reflector about the elevation axis of rotation.

The system does not have RF rotary joints. By positioning transmitters and receivers to rotate with the platform about the azimuth axis of rotation and to rotate with the reflector about the elevation axis of rotation, the RF rotary joints may be eliminated. Therefore, the first and second channel first transmitted waves and the first and second channel first reflected waves do not pass through RF rotary joints.

In one embodiment of the instant invention, a coherent transmitter subsystem generates a first radio signal, a second radio signal, a reference radio signal, a first receiver radio signal, and a second receiver radio signal. The coherent transmitter subsystem is an exciter, and it rotates with the platform. In another embodiment of the instant invention, the coherent transmitter subsystem, a first channel subsystem, and a second channel subsystem rotate with the platform and the reflector. The first channel subsystem has a first channel transmitter in electromagnetic communication with the coherent transmitter subsystem. The first channel transmitter receives the first radio signal and modulates it to produce the first channel first transmitted wave.

The first channel first transmitted wave travels to a first channel power monitor in electromagnetic communication with the first channel transmitter. The first channel power monitor allows sampling of the first channel first transmitted wave for analysis. The first channel first transmitted wave then passes through a first channel circulator.

The first channel circulator is in electromagnetic communication with both the first channel power monitor and the orthomode feed horn. The first channel circulator directs the first channel first transmitted wave toward the orthomode feed horn. The orthomode feed horn directs the first channel first transmitted wave onto a capture surface. The first channel first transmitted wave is reflected from the capture surface toward the object. The first channel first reflected wave returns to the capture surface from the object. The capture surface focuses the first channel first reflected wave to the orthomode feed horn. The first channel first reflected wave then passes to the first channel circulator which diverts the first channel first reflected wave to a first channel TR limiter.

The first channel TR limiter is in electromagnetic communication with the first channel circulator. The first channel TR limiter allows the passage of the first channel first reflected wave but blocks passage of high-power, damaging electromagnetic waves from entering the more sensitive components of the first channel subsystem.

Similar to the first channel subsystem, the second channel subsystem has a second channel transmitter in electromagnetic communication with the coherent transmitter subsystem. In brief, the second channel transmitter receives the second radio signal and modulates it to produce the second channel first transmitted wave. The second channel circulator is in electromagnetic communication with both the second channel power monitor and the orthomode feed horn. A second channel receiver is in electromagnetic communication with the second channel TR limiter and the coherent transmitter subsystem. The second channel receiver receives the second channel first reflected wave and the second receiver radio signal. The second channel receiver converts the second channel first reflected wave into a second received wave.

An analyzer subsystem is in electrical communication with the azimuth control system, the elevation control system, the first channel receiver, the second channel receiver, and the coherent transmitter subsystem. The analyzer subsystem receives the azimuth position signal, the elevation position signal, the first received wave, the second received wave, and the reference radio signal. The analyzer subsystem compares the reference radio signal, the first channel first transmitted wave, the second channel first transmitted wave, the first received wave, and the second received wave for the azimuth position signal and the elevation position signal.

In one embodiment of the instant invention, since there are at least two subsystems, the first channel first transmitted wave frequency may be different from the second channel first transmitted wave frequency. Similarly, the two channel subsystems may be operated such that the first and second channel first transmitted waves have different phases, polarizations, and angles of polarization. In another embodiment of the present invention, the first channel subsystem emits a first channel second transmitted wave and the second channel subsystem emits a second channel second transmitted wave.

These variations, modifications, alternatives, and alterations of the various preferred embodiments may be used alone or in combination with one another, as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

A multitransmitter RF rotary joint free weather radar system (60) of the instant invention enables a significant advance in the state of the art. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
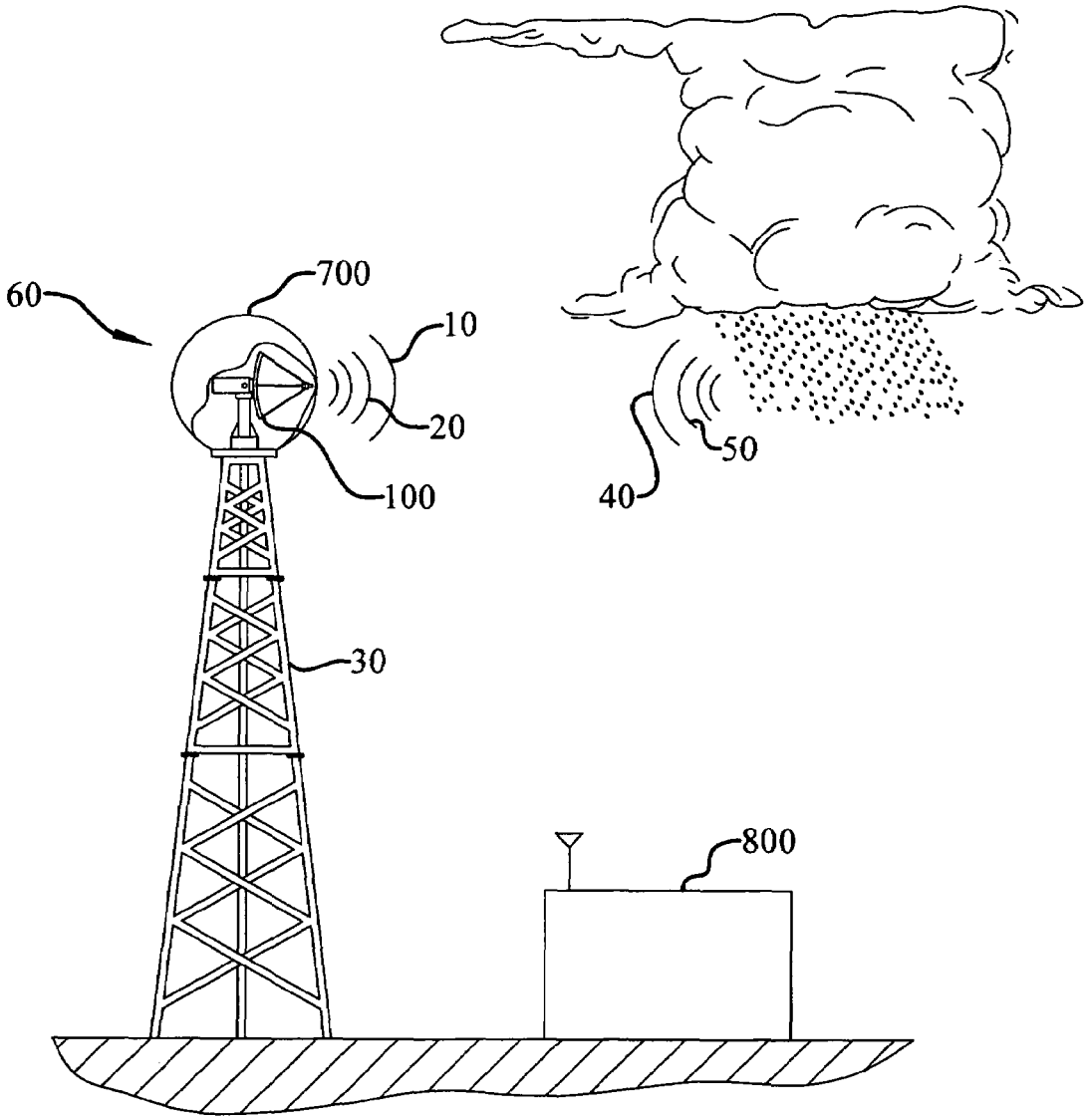
FIG. 1 is an elevation view of an embodiment of the multitransmitter RF rotary joint free weather radar system of the present invention fixed at the top of a tower and having a radome, not to scale.
Figure 2:
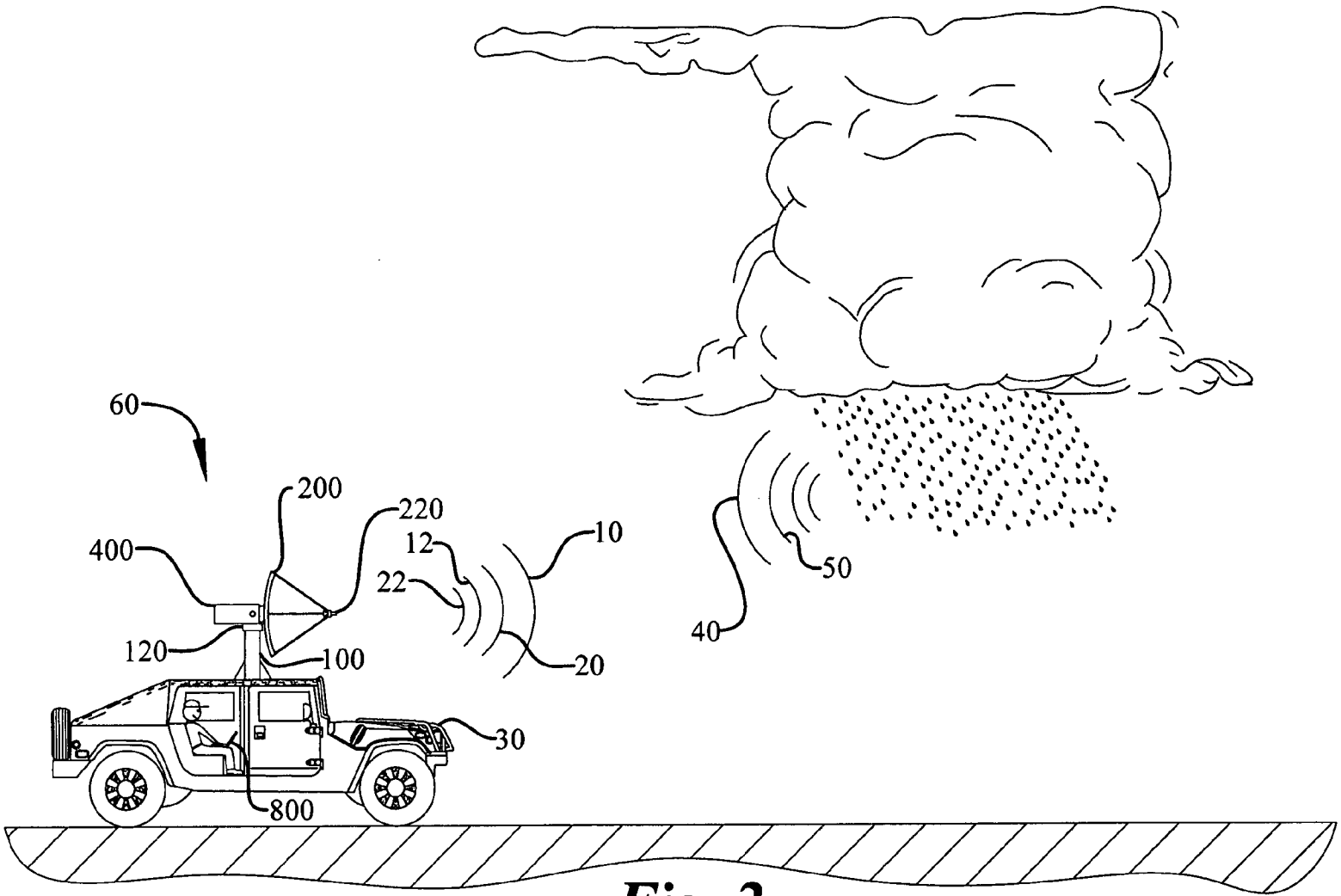
FIG. 2 is an elevation view of an embodiment of the multitransmitter RF rotary joint free weather radar system of the present invention fixed on a mobile base, not to scale.

Referring now to FIGS. 1 and 2, in one embodiment of the multitransmitter RF rotary joint free weather radar system (60) of the present invention, the system (60) is mounted on a base (30). As one skilled in the art will observe, by way of example only, the base (30) may be a tower, as seen in FIG. 1, a building, or a mobile structure, such as a ship or a vehicle, as seen in FIG. 2.

As seen in FIG. 1, the system (60) is designed to emit a first channel first transmitted wave (10) and a second channel first transmitted wave (20), towards an object. For example, as seen in FIGS. 1 and 2, the objects may be hydrometeors (i.e. rain drops, ice crystals, hail, graupel, and snow). The system (60) then receives a first channel first reflected wave (40) and a second channel first reflected wave (50), after the first channel first transmitted wave (10) and the second channel first transmitted wave (20), respectively, reflect from the object.

In summary, the system (60) is a weather radar system where the first and second channel first transmitted waves (10, 20) may have two independent frequencies, polarizations, phases, and angles of polarization. In addition, the system (60) has frequency, phase, polarization, and angle of polarization agility between any two successive transmissions. In other words, the system (60) is capable of altering the frequency, phase, polarization, and angle of polarization of the first channel first transmitted wave (10) independently of the second channel first transmitted wave's (20) frequency, phase, polarization, and angle of polarization on a pulse-by-pulse basis. The term angle of polarization, as used herein, means an angle lying in a plane, where the plane is constructed perpendicular to a direction of wave propagation. The angle is measured between a horizontally polarized transmitted wave and the wave in question. For example, a vertically polarized transmitted wave has an angle of polarization of ninety degrees. In addition, the term pulse as used herein means the transmission of the first or second channel first transmitted wave (10, 20). The first and second channel first transmitted wave (10, 20) could be either a finite or continuous wave train. Furthermore, a finite wave train pulse has a pulse length measured by the time a transmitter is energized. Now, with reference generally to FIGS. 1 through 7, the system (60) will be generally described.

With reference to FIG. 1, in one embodiment of the present invention, an antenna pedestal (100) is attached to the base (30). The antenna pedestal (100) may be mounted in a radome (700) constructed of a radio frequency (RF) transparent material, which is known in the art. The radome (700) provides a pressure, humidity, and temperature controlled environment for protecting critical RF components from unforgiving, destructive elements. As seen best in FIG. 3, the antenna pedestal (100) has a platform support (110) and a platform (120). The platform (120) is rotatably coupled to the platform support (110). A reflector (200) rotates with the platform (120) about an azimuth axis of rotation (160). The reflector (200) also rotates about an elevation axis of rotation (170), as will be further discussed later.

Figure 3:
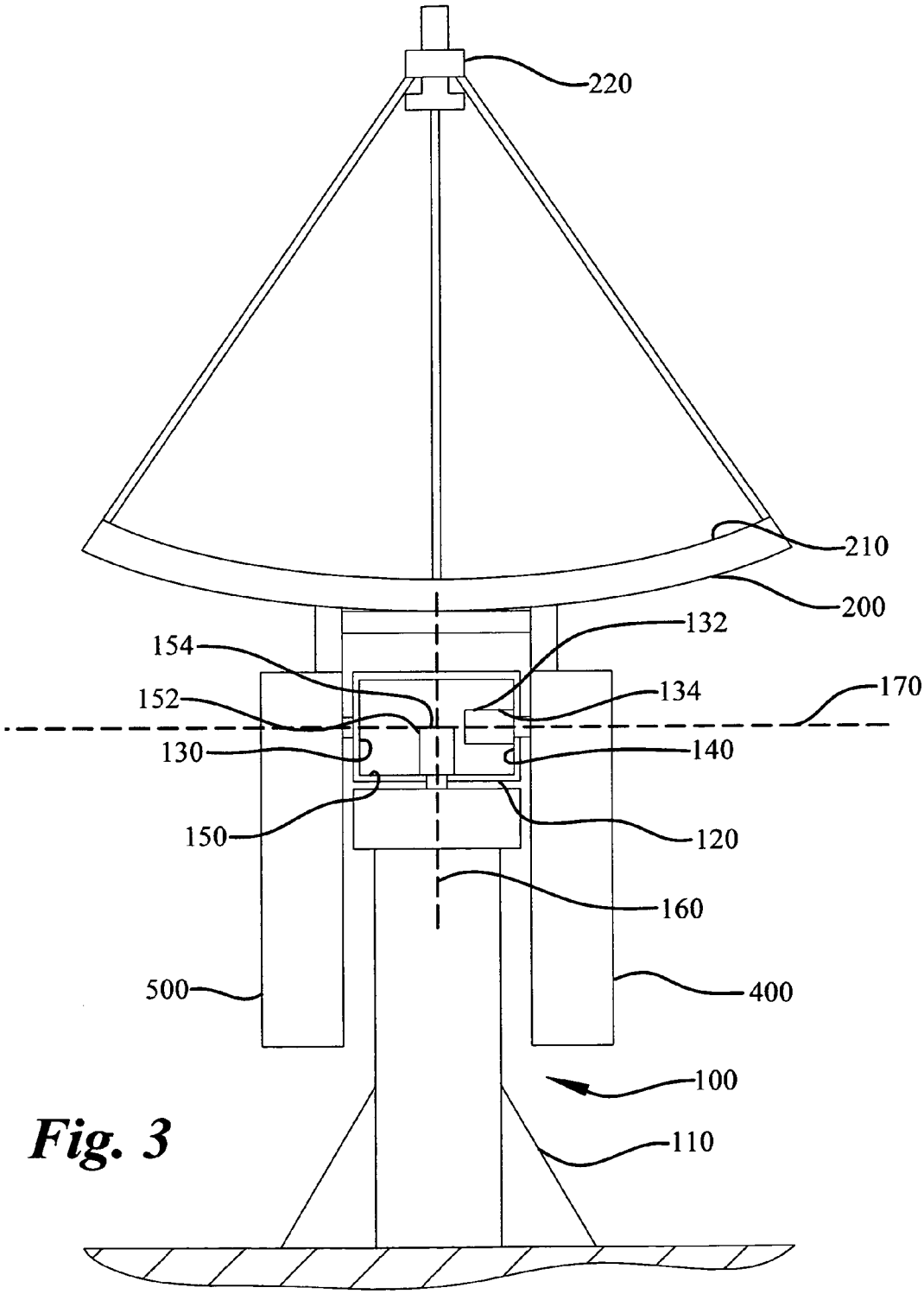
FIG. 3 is an elevation view of an embodiment of the multitransmitter RF rotary joint free weather radar system of the present invention showing the position of a first and second channel subsystems rotating with a platform, not to scale.
Figure 4:
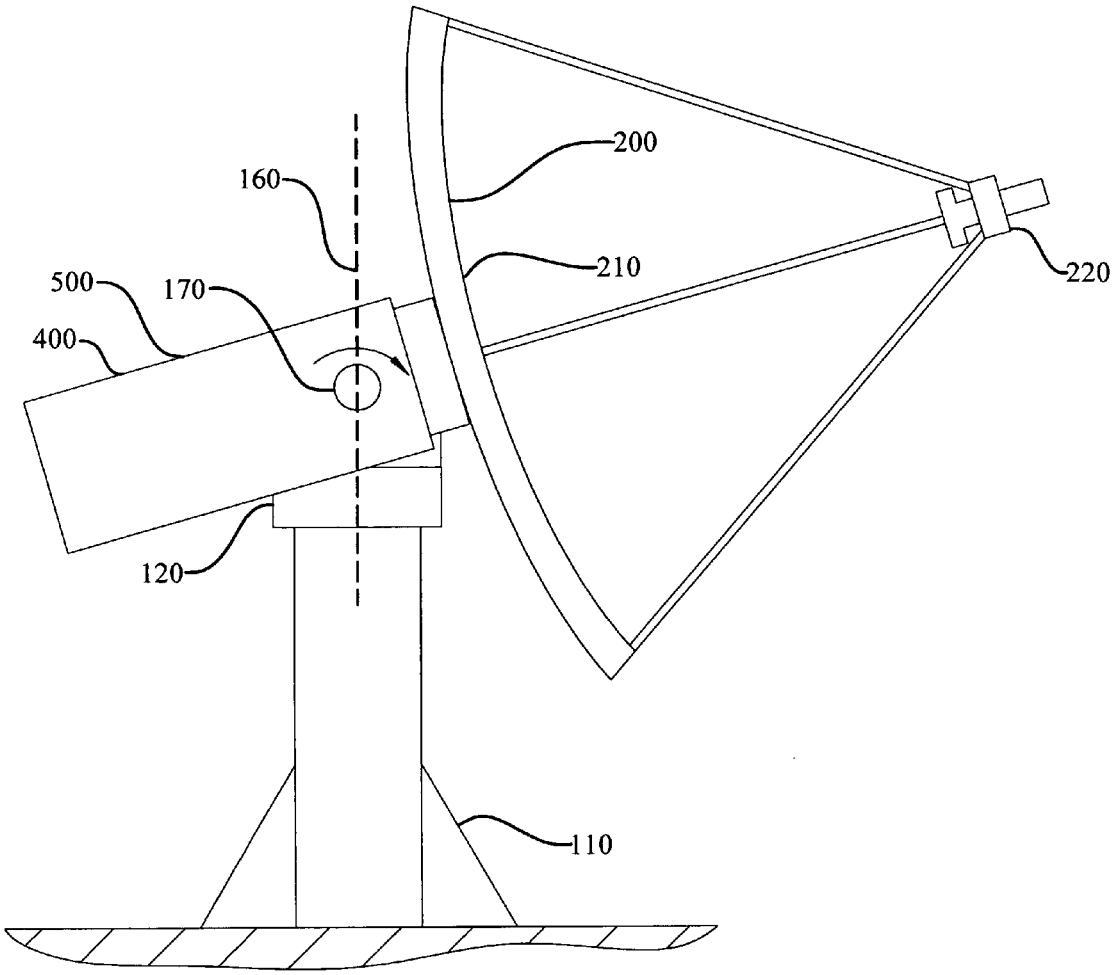
FIG. 4 is an elevation view of an embodiment of the multitransmitter RF rotary joint free weather radar system of the present invention showing the reflector rotated about an elevation axis of rotation and the platform and the reflector rotated about an azimuth axis of rotation, not to scale.

Now with regard to the azimuth axis of rotation (160), as seen in FIGS. 3 and 4, the platform (120) has a platform base (150) having a sinistral side (130) and a dextral side (140). The sinistral side (130) and the dextral side (140) extend perpendicular from the platform base (150). In other words, the platform base (150) has two sides creating a roughly U-shaped platform (120). The azimuth axis of rotation (160) extends through the platform base (150) to the platform support (110). The platform (120) is rotatably coupled to the platform support (110), which allows the platform (120) to rotate around the azimuth axis of rotation (160). Thus, the platform (120), as seen in FIGS. 3 and 4, may be oriented in any azimuth direction by rotating the platform (120) clockwise or counterclockwise around the azimuth axis of rotation (160), seen in FIGS. 3 and 4. In another embodiment of the instant invention, an azimuth control system (152) having an azimuth motor (154), such as a servomotor type in electrical communication with an azimuth servomotor controller, which are known in the art, orients the reflector (200), and everything mounted to the platform (120), with respect to the azimuth axis of rotation (160). The azimuth control system (152) may be mounted to and rotate with the platform (120). However, the azimuth control system (152) may also be fixed to the platform support (110) with the azimuth motor (154) enabling the rotation of the platform (120). Thus, the azimuth control system (152) may or may not rotate with the platform (120). The advantages of having the azimuth control system (152) mounted to and rotating with the platform (120) are described below.

As previously mentioned, the elevation axis of rotation (170) permits rotation of the reflector (200) and everything fixed thereto, as described later, along a vertical arc. For example, as seen in FIG. 3, the reflector (200) may rotate about the elevation axis of rotation (170) from a "rain catching" elevation position to an operational elevation position, as seen in FIG. 4, or to any elevation position in between. With continued reference to FIGS. 3 and 4, the elevation axis of rotation (170) extends from the sinistral side (130) to the dextral side (140) substantially parallel to the platform base (150). In one embodiment of the instant invention, an elevation control system (132) orients the reflector (200) with respect to the elevation axis of rotation (170). Thus, the azimuth control system (152) and the elevation control system (132), acting together, coordinate the overall orientation of the reflector (200).

Figure 6:
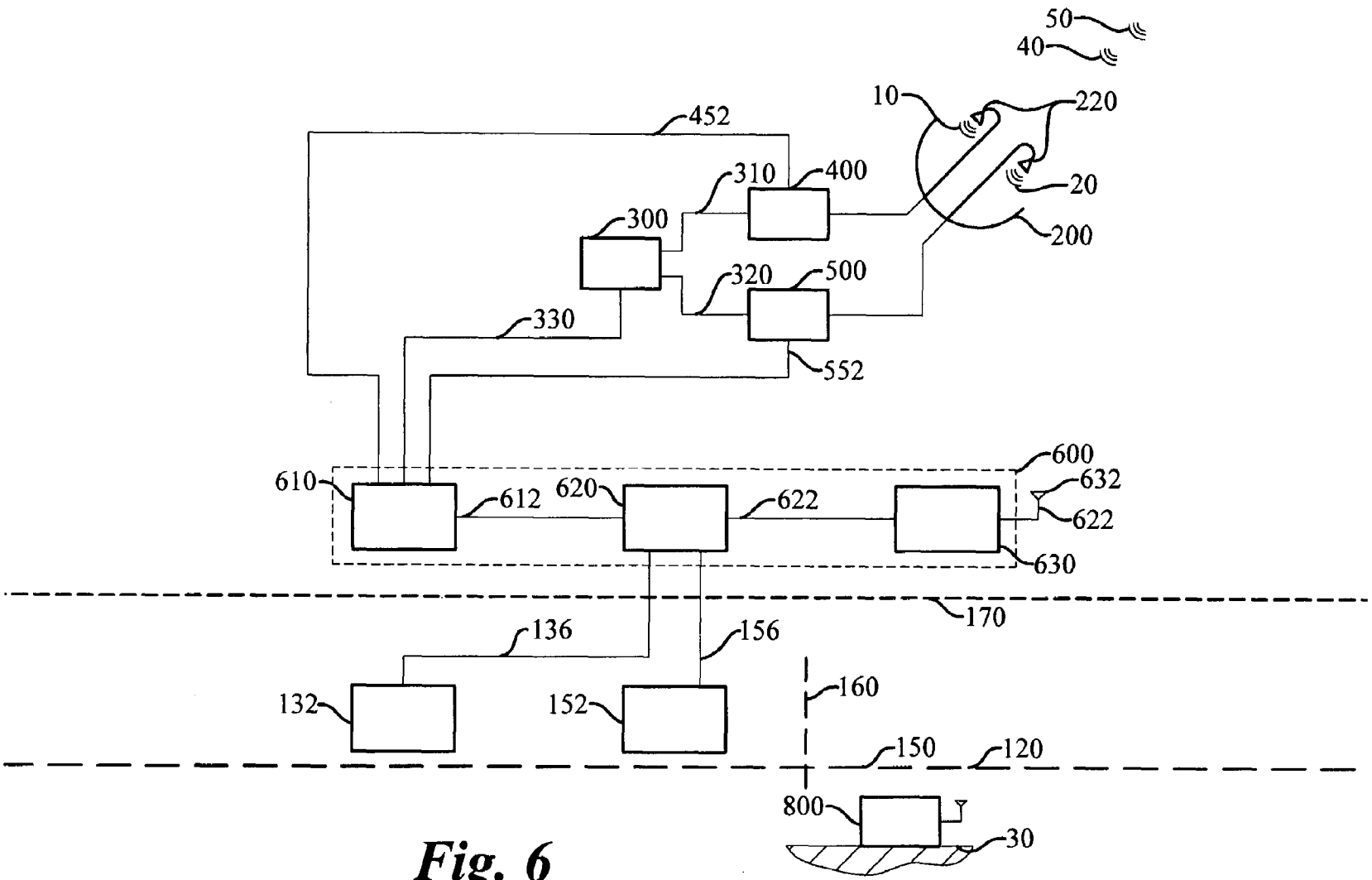
FIG. 6 is a schematic of an embodiment of the multitransmitter RF rotary joint free weather radar system of the present invention showing a position of an analyzer subsystem, an azimuth control system, and the elevation control system relative to the azimuth axis of rotation and the elevation axis of rotation, not to scale.

In another embodiment of the instant invention, as seen in FIG. 3, the elevation control system (132) incorporates at least one elevation motor (134) such as a servomotor type in electrical communication with an elevation servomotor controller mounted to, and rotating with, the platform base (150). By positioning the azimuth control system (152) and the elevation control system (132) on the platform base (150), slip rings, which are known in the art to create noise in electrical signals and are also known to require regular preventive maintenance, are eliminated. Consequently, the performance, reliability, and cost of the system (60) is improved versus the prior art radar systems. For example, as seen in FIG. 6, the azimuth control system (152) generates an azimuth position signal (156) and the elevation control system (132) generates an elevation position signal (136) to track the position of the reflector (200) with respect to the transmission of the first channel first transmitted wave (10) and the second channel first transmitted wave (20) and with respect to the reception of the corresponding first channel first reflected wave (40) and second channel first reflected wave (50). In one embodiment, with both the azimuth control system (152) and the elevation control system (132) mounted to and rotating with the platform (120), a slip ring for transferring the azimuth position signal (156) and the elevation position signal (136) between other portions of the system (60), as discussed below, are not required.

Now, with reference to FIG. 3, in an embodiment of the instant invention, the reflector (200) has a capture surface (210) and an orthomode feed horn (220). The orthomode feed horn (220) may be similar to those available from Seavey Engineering. While the figures illustrate the reflector (200) having a parabolic-dish shape, as is commonly used in the art, other reflector (200) shapes are contemplated. By way of example and not limitation, the reflector (200) may simply be a piece of waveguide having slots cut through its sidewalls, also known as a slotted array, or the reflector (200) may be flat, similar to those utilized on marine vessels. With reference to FIG. 2, as the reflector (200) rotates, the orthomode feed horn (220) directs the first channel first transmitted wave (10) and the second channel first transmitted wave (20) to the capture surface (210). The reflector (200) reflects or directs the first channel first transmitted wave (10) and the second channel first transmitted wave (20) toward the object. As is known in the art, a portion of the first channel first transmitted wave (10) and a portion of the second channel first transmitted wave (20) reflect or are scattered by the object.

As seen in FIGS. 1 and 2, the scattered or reflected waves travel back toward the reflector (200). The first channel first reflected wave (40) corresponds to the reflected portion of the first channel first transmitted wave (10), and the second channel first reflected wave (50) corresponds to the reflected portion of the second channel first transmitted wave (20). The first and second channel first reflected waves (40, 50) strike the capture surface (210), only seen in FIG. 3, which focuses the first channel first reflected wave (40) and the second channel first reflected wave (50) to the orthomode feed horn (220).

Figure 5:
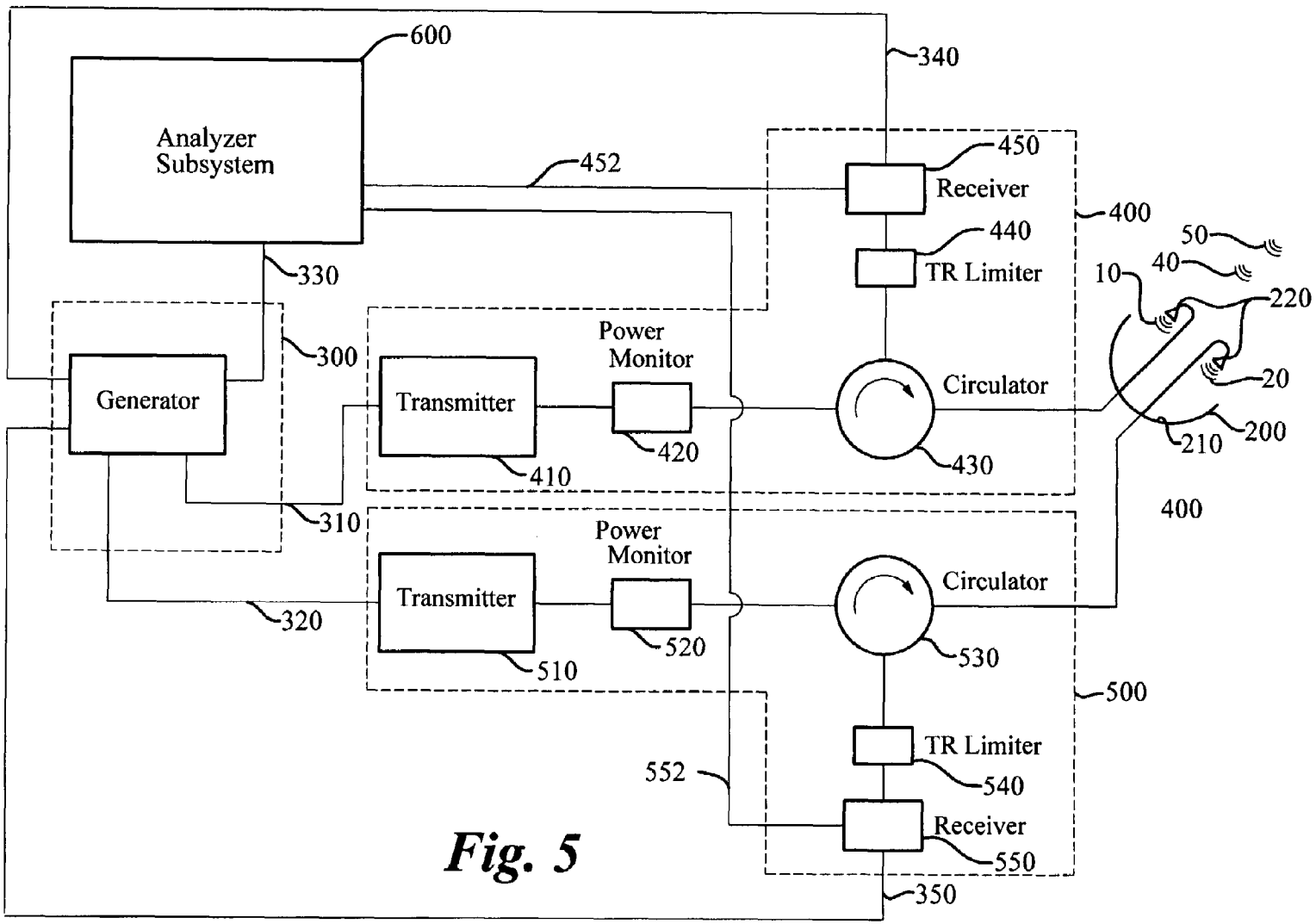
FIG. 5 is a schematic of an embodiment of the multitransmitter RF rotary joint free weather radar system of the present invention showing connectivity between the components of the system, not to scale.
Figure 7:
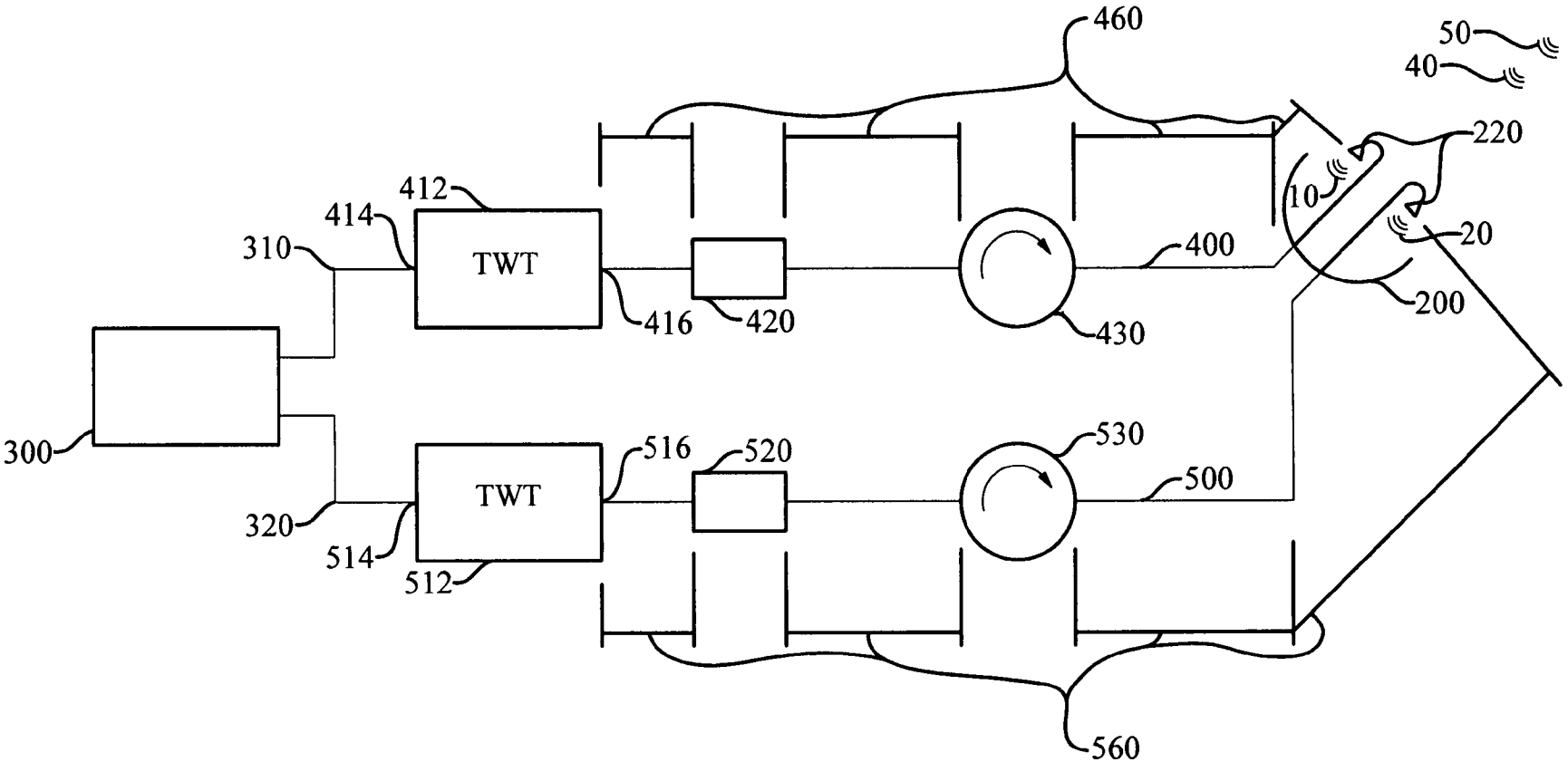
FIG. 7 is a schematic of an embodiment of the multitransmitter RF rotary joint free weather radar system of the present invention showing a first and a second channel waveguide length, not to scale.

Referring now to FIGS. 5, 6, and 7, in an embodiment of the instant invention, the components for generating the first and the second channel first transmission waves (10, 20), as well as, the components for receiving the first and the second channel first reflected waves (40, 50), will be described. In addition to lacking the prior art slip rings, one skilled in the art will quickly notice that the embodiment shown in FIG. 6 does not have RF rotary joints. By eliminating the RF rotary joints, the system (60) is less expensive to install, and yet the system (60) has superior performance because the first and second channel first transmitted waves (10, 20) and the first and second channel first reflected waves (40, 50) do not pass through RF rotary joints. In one particular embodiment of the instant invention, only the electrical power for rotating the platform (120), and powering supporting electronics is supplied to the platform (120) through an electrical slip ring. Therefore, the first and second channel first transmitted waves (10, 20) are not attenuated nor do they suffer phase pollution as they pass through RF rotary joints.

In one embodiment of the instant invention, as seen in FIG. 5, a coherent transmitter subsystem (300) generates a plurality of signals, such as, a first radio signal (310), a second radio signal (320), a reference radio signal (330), a first receiver radio signal (340), and a second receiver radio signal (350). The coherent transmitter subsystem (300) includes at least one exciter, and, as seen in FIG. 6, the coherent transmitter subsystem (300) rotates with the platform (120) and the reflector (200). As one skilled in the art will observe and appreciate, the coherent transmitter subsystem (300) may be electrically powered by one or more transformers. The transformer takes generally available industrial power, for example, single-phase or three-phase electrical power, and transforms that industrial power into a form that is usable by the coherent transmitter subsystem (300). In one particular embodiment, the transformer rotates with the platform (120). As seen in FIGS. 5 and 6, the coherent transmitter subsystem (300) is in electrical communication with a first channel subsystem (400) and a second channel subsystem (500). While the discussion herein is with respect to the first and second channel subsystems (400, 500), the system (60) is not so limited. Thus, the system (60) may encompass multiple channels with each channel having independent frequencies, phases, polarizations, and angles of polarization.

Now, the position of the first and second channel subsystems (400, 500) is discussed. Referring back to FIGS. 3 and 4, in one embodiment of the instant invention and unlike prior art weather radar systems, the first channel subsystem (400), the second channel subsystem (500), and the reflector (200) are rotatably coupled about the elevation axis of rotation (170), such that a weight of the reflector (200) is counterbalanced in part by a weight of the first channel subsystem (400) and a weight of the second channel subsystem (500) across the elevation axis of rotation (170), best seen in FIG. 4. Counterbalancing the weight of the reflector (200) with the weight of the first and second channel subsystems (400, 500) reduces wear on the system (60) by balancing a moment of inertia of the rotating reflector (200) with a moment of inertia of the first and second channel subsystems (400, 500). As previously mentioned, the first and second channel subsystems (400, 500) are positioned to move relative to the reflector (200). For example, as seen in FIG. 4, as the reflector (200) rotates about the azimuth axis of rotation (160), the first and second channel subsystems (400, 500) also rotate about the azimuth axis of rotation (160). Similarly, when the reflector (200) is pivoted to point upward, for example, at forty-five degrees relative to the earth, as seen in FIG. 4, the first and second channel subsystems (400, 500) rotate in unison.

By coupling the motion of the reflector (200) to the first and second channel subsystems (400, 500), relative motion between the first and second channel subsystems (400, 500) and the reflector (200) is eliminated. In other words, the first and second channel first transmitted waves (10, 20) travel through the first and second channel subsystems (400, 500) to the reflector (200) without passing through RF rotary joints. Now, the components of the system (60) and their connectivity will be generally described.

In one embodiment of the instant invention, as seen in FIG. 5, the coherent transmitter subsystem (300) sends the first radio signal (310) to a first channel transmitter (410) of the first channel subsystem (400) which generates the first channel first transmitted wave (10). Similarly, the coherent transmitter subsystem (300) sends the second radio signal (320) to a second channel transmitter (510) of the second channel subsystem (500) which generates the second channel first transmitted wave (20). Furthermore, the first channel subsystem (400) and the second channel subsystem (500) are in electromagnetic communication with the orthomode feed horn (220). Electromagnetic communication means that the components are connected with a waveguide appropriate to allow passage of a transmitted wave without substantial attenuation or introduction of phase errors into the transmitted wave. As one skilled in the art will observe and appreciate, depending on the application, band pass and harmonic filters, as well as other devices, may be required to condition the first and second first transmitted waves (10, 20) prior to emission. Each of the first and second channel subsystems (400, 500) will now be described in greater detail.

As seen in FIG. 5, in one embodiment of the instant invention, the first channel transmitter (410) is in electromagnetic communication with the coherent transmitter subsystem (300). In one embodiment of the instant invention, as seen only in FIG. 7, the first channel transmitter (410) is a first traveling wave tube amplifier (412). Traveling wave tubes (TWTs) do not require extensive electromagnetic shielding to prevent distortion and induction of electrical noise in surrounding circuits. Consequently, TWTs are lighter and more compact, allowing the first channel subsystem (400) to be elevated into a rotatable position with respect to the reflector (200), as seen in FIG. 3. And, in one particular embodiment, the traveling wave tube is a grid-pulsed TWT, such as Model MTG 3041, manufactured by Teledyne MEC. The grid-pulsed TWT has longer life which reduces maintenance and overall costs of the system (60). In another embodiment of the instant invention, the first channel transmitter (410) is a solid state amplifier or a Klystron, which are known in the art. With reference back to FIG. 5, the first channel transmitter (410) receives the first radio signal (310) and modulates it to produce the first channel first transmitted wave (10). The first channel first transmitted wave (10) is described by a plurality of first wave characteristics, such as, a first channel first transmitted wave frequency, a first channel first transmitted wave phase, a first channel first transmitted wave polarization, a first channel first transmitted wave angle of polarization, and a first channel first transmitted wave pulse length.

With continued reference to FIG. 5, the first channel first transmitted wave (10) travels to a first channel power monitor (420) in electromagnetic communication with the first channel transmitter (410). The first channel power monitor (420) allows burst pulse sampling of the first channel first transmitted wave (10) to determine of how much power is leaving the first channel transmitter (410) and at what phase and frequency. In one embodiment of the instant invention, the first channel power monitor (420) is a passive device, such as a forward-reverse power coupler, for sampling of the first channel first transmitted wave (10) at a reduced power level and serves to monitor an operating status the first channel transmitter (410). A suitable first channel power monitor (420) is comprised of a 40 dB power coupler available from Space Machine Engineering, Corp. in combination with a Miteq mixer. The first channel first transmitted wave (10) then passes through a first channel circulator (430).

The first channel circulator (430) is in electromagnetic communication with both the first channel power monitor (420) and the orthomode feed horn (220), as seen in FIG. 5. The first channel circulator (430) directs the first channel first transmitted wave (10) toward the orthomode feed horn (220). In one embodiment, the first channel circulator (430) is a typical ferrite circulator, which are known in the art, such as model JG42 available from Channel Microwave Corp. As previously discussed, the first channel first transmitted wave (10) is directed by the orthomode feed horn (220) onto the capture surface (210) and is reflected from the capture surface (210) toward the object. The first channel first reflected wave (40) returns to the capture surface (210) from the object. The capture surface (210) focuses the first channel first reflected wave (40) to the orthomode feed horn (220). The first channel first reflected wave (40) then passes to the first channel circulator (430) which diverts the first channel first reflected wave (40) to a first channel TR limiter (440).

As seen in FIG. 5, the first channel TR limiter (440) is in electromagnetic communication with the first channel circulator (430). The first channel TR limiter (440) allows the passage of the first channel first reflected wave (40); however, as is known in the art, the first channel TR limiter (440) blocks passage of high-power, damaging electromagnetic waves from entering the more sensitive components of the first channel subsystem (400). In particular, the first channel TR limiter (440) prevents the first channel first transmitted wave (10) from passing through it in the event that the first channel circulator (430) inadvertently directs the first channel first to transmitted wave (10) toward the TR limiter (440). A first channel TR limiter (440) suitable for use in one embodiment of the present invention is model HL5 pindoide from Hill Engineering, a division of Comtech PST Corp., or alternatively, the first channel TR limiter (440) may be multiple diodes.

With continued reference to FIG. 5, a first channel receiver (450) is in electromagnetic communication with the first channel TR limiter (440), the coherent transmitter subsystem (300), and an analyzer subsystem (600). The first channel receiver (450) receives the first channel first reflected wave (40), which passes through the TR limiter (440), and the first receiver radio signal (340), which is sent by the coherent transmitter subsystem (300). As previously mentioned, the first channel TR limiter (440) prevents high power electromagnetic waves, such as the first channel first transmitted wave (10) from entering the first channel receiver (450). Depending upon the application, a signal processor may be integrated into the first channel receiver (450). Thus, in one embodiment, the first channel receiver (450) may convert the first channel first reflected wave (40) into a first received wave (452) via intermediate frequency (IF) down-conversion or IF mixdown, which is known in the art. In summary, neither of the first channel first transmitted wave (10) nor the first channel first reflected wave (40) passes through an RF rotary joint at any point in the first channel subsystem (400).

Similar to the first channel subsystem (400), and with continued reference to FIG. 5, the second channel subsystem (500) has the second channel transmitter (510) in electromagnetic communication with the coherent transmitter subsystem (300). The second channel transmitter (510) receives the second radio signal (320) and modulates it to produce the second channel first transmitted wave (20). In one embodiment of the instant invention, as seen in FIG. 7, the second channel subsystem (500) is a second traveling wave tube amplifier (512). Traveling wave tubes (TWTs) do not require extensive shielding to prevent distortion and induction of electrical noise in surrounding circuits. Consequently, TWTs are lighter and more compact, allowing them to be elevated into a rotatable position with respect to the reflector (200). And, in one particular embodiment, the TWT is a grid-pulsed TWT, Model MTG 3041, manufactured by Teledyne MEC. The grid-pulsed TWT has longer life which reduces maintenance and overall costs of the system (60). In another embodiment of the instant invention, the second channel transmitter (510) is a solid state amplifier or Klystron, which are known in the art. As seen in FIG. 7, in one embodiment of the instant invention, the first channel transmitter (410) and the second channel transmitter (510) are both TWTs. However, the first channel transmitter (410) and the second channel transmitter (510) need not be equivalent devices, for example, the first channel transmitter (410) may be a TWT while the second channel transmitter (510) is a solid state amplifier. Similar to the first wave characteristics, the second channel first transmitted wave (20) is described by a plurality of second wave characteristics, such as a second channel first transmitted wave frequency, a second channel first transmitted wave phase, a second channel first transmitted wave angle of polarization and a second channel first transmitted wave pulse length.

The second channel first transmitted wave (20) travels to a second channel power monitor (520) in electromagnetic communication with the second channel transmitter (510), as seen in FIG. 5. The second channel power monitor (520) allows sampling of the second channel first transmitted wave (20) for analysis. In one embodiment of the instant invention, the second channel power monitor (520) is a passive device, such as a forward-reverse power coupler, for sampling of the second channel first transmitted wave (20) at a reduced power level, and serves to monitor an operating status of the second channel transmitter (510). The second channel first transmitted wave (20) then passes through a second channel circulator (530).

With reference to FIG. 5, the second channel circulator (530) is in electromagnetic communication with both the second channel power monitor (520) and the orthomode feed horn (220). The second channel circulator (530) directs the second channel first transmitted wave (20) toward the orthomode feed horn (220). In one embodiment, the second channel circulator (530) is a typical ferrite circulator, which are known in the art, such as model JG42 available from Channel Microwave Corp. As previously discussed, the second channel first transmitted wave (20) is directed by the orthomode feed horn (220) onto the capture surface (210) and is reflected from the capture surface (210) toward the object. The second channel first reflected wave (50) returns to the capture surface (210) from the object. The capture surface (210) focuses the second channel first reflected wave (50) into the orthomode feed horn (220) and passes to the second channel circulator (530). The second channel circulator (530) diverts the second channel first reflected wave (50) to a second channel TR limiter (540).

The second channel TR limiter (540) is in electromagnetic communication with the second channel circulator (530), as seen in FIG. 5. The second channel TR limiter (540) allows the passage of the second channel first reflected wave (50); however, as is known in the art, the second channel TR limiter (540) blocks passage of high-power, damaging electromagnetic waves from entering the more sensitive components of the second channel subsystem (500). In particular, the second channel TR limiter (540) prevents the second channel first transmitted wave (20) from passing through it in the event that the second channel circulator (530) inadvertently directs the second channel first transmitted wave (20) toward the second channel TR limiter (540).

With continued reference to FIG. 5, a second channel receiver (550) is in electromagnetic communication with the second channel TR limiter (540), the coherent transmitter subsystem (300), and the analyzer subsystem (600). The second channel receiver (550) receives the second channel first reflected wave (50), which passes through the second channel TR limiter (540), and the second receiver radio signal (350), which is sent by the coherent transmitter subsystem (300). As previously mentioned, the second channel TR limiter (540) prevents high power electromagnetic waves, such as the second channel first transmitted wave (20) from entering the second channel receiver (550). Depending upon the application, a signal processor may be integrated into the second channel receiver (550). Thus, in one embodiment, the second channel receiver (550) may convert the second channel first reflected wave (50) into a second received wave (552) via intermediate frequency (IF) down-conversion or IF mixdown, which is known in the art. Once again, in summary, neither of the second channel first transmitted wave (20) nor the second channel first reflected wave (50) passes through an RF rotary joint.

Referring now to FIG. 6, the analyzer subsystem (600) is in communication with the azimuth control system (152), the elevation control system (132), the first channel receiver (450), the second channel receiver (550), and the coherent transmitter subsystem (300). The analyzer subsystem (600) may be in electrical communication, which includes wireless communication, with the aforementioned components, as will be described later, and therefore the analyzer subsystem (600) may be located remotely or locally.

The analyzer subsystem (600) receives the azimuth position signal (156), the elevation position signal (136), the first received wave (452), the second received wave (552), and the reference radio signal (330), as seen in FIG. 6. The analyzer subsystem (600) compares the reference radio signal (330), the first received wave (452), and the second received wave (552) for the azimuth position signal (156) and the elevation position signal (136), and may calculate one or more polarization radar parameters, such as, for example, a differential reflectivity, a linear depolarization ratio, a differential attenuation, or a differential phase shift. Furthermore, the linear polarization measurement may be either co-polar or cross-polar. The polarization radar parameters may be used to measure rainfall, detect hail, or identify hydrometer type, including the size and shape of the hydrometers.

As seen in FIG. 6, in another embodiment, the analyzer subsystem (600) includes an IF digitizer (610) in electrical communication with a system controller (620). In turn, the system controller (620) is in electrical communication with a data transmitter (630). In one embodiment of the instant invention, the data transmitter (630) is in electrical communication with a remote computer system (800) via a data communications cable. In another embodiment of the instant invention, as seen in FIG. 6, the data transmitter (630) may be in wireless communication with the remote computer system (800) through a wireless link (632). The wireless link (632) eliminates yet another slip ring. The IF digitizer (610) converts the first received wave (452) and the second received wave (552), received from both the first and second channel receivers (450, 550), to a readable format (612), which is any computer readable data, digital or otherwise, commonly available, for the system controller (620). The data transmitter (630) receives a plurality of data (622) from the system controller (620) and the data transmitter (630) transfers the data (622) to the remote computer system (800) via the wireless link (632). In another, related embodiment of the instant invention, the analyzer subsystem (600) rotates with the platform (120) and the analyzer subsystem (600) is in wireless communication with the remote computer system (800). As one skilled in the art will observe, the remote computer system (800) may be a laptop or other portable device, as seen in FIG. 2, in wireless communication with the analyzer subsystem (600) via the wireless link (632). In other words, the remote computer (800) may be physically located, for example, in the radome (700) or a large distance away.

In one embodiment of the instant invention, the first channel first transmitted wave frequency is different from the second channel first transmitted wave frequency. In another embodiment of the instant invention, the first and second channel first transmitted waves (10, 20) have frequencies of between approximately 3 GHz and approximately 35 GHz, that is, portions of the S-band to the K-band. As stated previously, the system (60) has frequency and phase agility. Unlike prior art dual polarized radar systems having power splitters or the like, the system (60) is capable of operating each of the first and second channel subsystems (400, 500) such that the first and second first transmitted waves (10, 20) have different frequencies.

Similarly, the first and second channel subsystems (400, 500) may be operated such that the first and second channel first transmitted waves (10, 20) have different phases, polarizations, and angles of polarization. For example, the first channel first transmitted wave (10) may be plane polarized in a horizontal orientation while the second channel first transmitted wave (20) may be circularly polarized. In one embodiment of the instant invention, the first and second channel first transmitted waves (10, 20) are plane polarized and have angles of polarization such that a polarization differential angle measured between the plane polarized first and second channel first transmitted waves (10, 20) is ninety degrees. In one particular embodiment, the first and second channel first transmitted waves (10, 20) are plane polarized and have angles of polarization corresponding to the horizontal and vertical polarizations commonly found in dual polarization radar systems. In another particular embodiment, the first and second channel first transmitted waves (10, 20) are plane polarized by the orthomode feed horn (220).

In another embodiment of the present invention, following transmission of the first and second first transmitted waves (10, 20), the first channel subsystem (400) emits a first channel second transmitted wave (12) and the second channel subsystem (500) emits a second channel second transmitted wave (22), as seen in FIG. 2. Like the first and second channel first transmitted waves (10, 20), the first channel second transmitted wave (12) has a first channel second transmitted wave frequency, and the second channel second transmitted wave (22) has a second channel second transmitted wave frequency. However, the first and second channel second transmitted wave frequencies may be different from the first and second channel first transmitted wave frequencies. Thus, the system's (60) frequency agility is not limited to simply having two channels operating at different frequencies. The system (60) is capable of changing the first and second channel second transmitted wave frequencies following emission of the first and second channel first transmitted waves (10, 20). Unlike prior art systems having a single transmitter transmitting waves at a single frequency and using power splitters to create two polarized waves, the system (60) has two transmitters that may be operated independently. The system (60) is therefore capable of quickly adjusting to weather conditions. Thus, the system (60) may allow more detailed and accurate investigation of weather systems by analyzing the weather condition with a variety of frequencies, phases, and polarizations.

Figure 8:
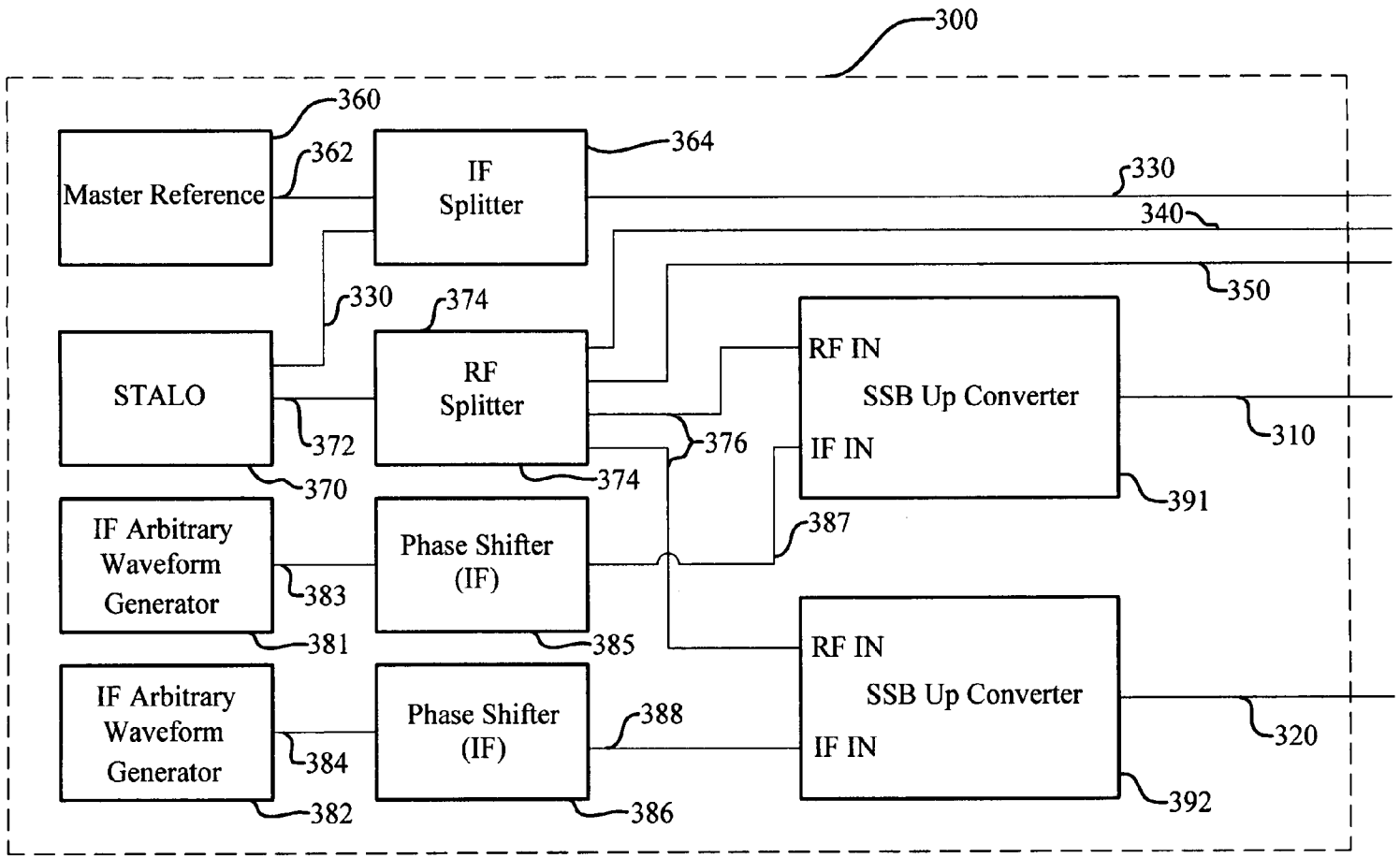
FIG. 8 is a schematic of an embodiment of a coherent transmitter subsystem of the multitransmitter RF rotary joint free weather radar system showing connectivity of the components of the coherent transmitter, not to scale.

The frequency, phases, and polarization agility of the present invention will now be explained with reference to FIG. 8. In one embodiment of the present invention, the coherent transmitter subsystem (300), seen in FIG. 5, consists of a number of components. As seen in FIG. 8, the first radio signal (310), the second radio signal (320), the reference radio signal (330), the first receiver radio signal (340), and the second receiver radio signal (350) are generated by a series of devices. As seen in FIG. 8, the first radio signal (310) issues from a first up converter (391) and, similarly, the second radio signal (320) issues from a second up converter (392), the first and second up converters (391, 392) may be SSB up converters similar to those from Miteq of New York.

The first up converter (391) receives a working RF signal (376) from an RF splitter (374), also available from Miteq. As seen in FIG. 8, an initial RF signal (372) is emitted by a local oscillator (370) often referred to as a stable local oscillator (STALO), which is known in the art. The first up converter (391) up converts a first phase shifted IF signal (387) with the working RF signal (376) in order to generate the first radio signal (310). The first phase shifted IF signal (387), in turn, is emitted by a first phase shifter (385) after receiving a first IF waveform (383) from a first IF waveform generator (381), similar to the Sigmet RVP-8 TX. By way of example and not limitation, the first IF waveform (383) may have a frequency of between approximately 30 MHz and approximately 72 MHz, which is common in the industry.

Similarly, the second up converter (392) receives a second phase shifted IF signal (388) from a second phase shifter (386) after receiving a second IF waveform (384) from a second IF waveform generator (382). By way of example and not limitation, the second IF waveform (384) may have a frequency of between approximately 30 MHz and approximately 72 MHz, which is common in the industry. As seen in FIG. 8, the local oscillator (370) receives the reference radio signal (330) from an IF splitter (364). In one particular embodiment of the instant invention, the reference radio signal (330) provides an internal reference back (not shown) to the first and second IF waveform generators (381, 382). The IF splitter (364) receives a primary radio reference signal (362) from an IF reference (360), such as a 10 MHz TCXO available from Luff Research in Floral Park, N.Y., which generally makes the system (60) coherent.

Thus, as previously discussed, the system (60) may vary any one, or a combination, of the first and second first transmitted wave characteristics individually between the first and second channel subsystems (400, 500), as well as, from the first and second channel first transmitted waves (10, 20) to the first and second channel second transmitted wave (12, 22). By way of example and not limitation, first and second channel first transmitted waves (10, 20) may differ in frequency by software control of the first and second IF waveform generators (381, 382) such that the first IF waveform (383) has a frequency that is different from the second IF waveform (384). Also, the first and second channel first transmitted waves (10, 20) differ in polarization. By way of example only, by phase shifting the first IF waveform (383) with the first phase shifter (385) relative to the second IF waveform (384) such that the first phase shifted IF signal (387) phase is different from a phase of the second phase shifted IF signal (388), the polarization of the first and second channel first transmitted waves (10, 20) may vary. For example, polarization of the first and second first transmitted waves (10, 20) may include vertical polarization, horizontal polarization, clockwise circular polarization, counterclockwise circular polarization, and slant 45 degree polarization.

In another embodiment of the instant invention, as previously mentioned, the system (60) has phase and polarization agility. Similar to the system's (60) capability of varying the transmitted wave frequency, the system (60) may also modify the transmitted wave phase and angle of polarization between successive pulses, either between the first and second channel subsystems (400, 500), or within each channel independent of the other. For example, the first channel subsystem (400) may transmit a horizontally polarized wave while the second channel subsystem (500) emits a circularly polarized wave for the initial pulse. Then during a next pulse, the first channel subsystem (400) may transmit a circularly polarized wave while the second channel subsystem (500) switches to a vertically polarized wave. Ultimately, the system's (60) ability to change the frequency, phase, polarization, and angle of polarization for the first and second channel subsystems (400, 500) independently of the other channel is unique and allows the system (60) to adapt to changing weather conditions. The operator may then be able to extract more detailed information from potentially dangerous weather formations more quickly and accurately.

In addition to variation of the wave characteristics for the first and second channel subsystem (400, 500), the timing of the transmitted waves (10, 20) may also be varied. For example, when the first channel subsystem (400) pulses, the second channel subsystem (500) may delay before pulsing or not pulse at all. However, in one particular embodiment of the instant invention, the first channel subsystem (400) emits the first channel first transmitted wave (10) substantially simultaneously with the emission of the second channel first transmitted wave (20) from the second channel subsystem (500). Though in one embodiment of the instant invention each of the two channels each transmit one wave per pulse, the first and second channel subsystems (400, 500) may alternate pulsing.

In another embodiment of the instant invention, the system (60) is compact and lightweight. The first channel subsystem (400) has a first channel waveguide length (460), and the second channel subsystem (500) has a second channel waveguide length (560), as seen in FIG. 7. The first channel waveguide length (460) is a linear measurement of a total length of waveguide measured from the first channel transmitter (410) to the orthomode feed horn (220). Similarly, the second channel waveguide length (560) is a linear measurement of a total length of waveguide measured from the second channel transmitter (510) to the orthomode feed horn (220). In one embodiment, the first and second channel waveguide length (460, 560) are each less than four feet. In a system (60) operating at W-band frequencies, the first and second channel waveguide length (460, 560) may be less the one foot. As one skilled in the art will observe, as the first and second channel waveguide lengths (460, 560) are reduced, the amount of attenuation of the first and second channel first transmitted waves (10, 20) and the amount of attenuation of the first and second channel first reflected wave (40, 50) is reduced. In addition, as the first and second channel waveguide lengths (460, 560) are reduced, the cost of installing and operating the system (60) is reduced, which is in stark contrast to prior art systems having long runs of waveguide. Therefore, by positioning the first and second channel subsystems (400, 500) in rotational relation with the reflector (200), the first and second channel waveguide lengths (460, 560) are reduced considerably.

In yet another embodiment of the present invention, unlike the prior art radar systems using radioactive gas tubes, which have limited life, are expensive, and are plagued with environmental disposal problems, the first and second channel TR limiters (450, 550) may have high-speed solid-state diode switches. A suitable high-speed solid-state diode is the model HL5 pindoide from Hill Engineering, a division of Comtech PST Corp., or alternatively the first channel TR limiter (440) may be multiple diodes.

By eliminating the RF rotary joints and reducing the waveguide length, the system (60) may be operated at lower transmission powers than prior art systems. Yet the system (60) is unexpectedly characterized with improved performance. For example, a prior art system may utilize a reflector having a beam width of 1 degree and a gain of 44.2 dB and a transmit power of 500 kW with a pulse width of 1 microsecond at a wavelength of approximately 3.22 cm. If a target is positioned at 50 km, a received pulse width may be approximately 0.73 BT. Estimating radome losses at this power and frequency of approximately 2 dB for the vertically polarized wave and 1 dB for a horizontally polarized wave and an IF filter loss of 2.2 dB, the radar constant is approximately $1.75*10^6$ $mm^6$ $m^{-3}$ $km^{-2}$ $mW^{-1}$. Therefore, for a −15.6 dBZ level target, under normal operating conditions an input received power sensitivity may be −113.0 dBm.

In sharp contrast, in one embodiment of the system (60) of the instant invention the transmit power is 29 kW and the transmitted waves (10, 20) have a 40 microsecond pulse width with a wavelength of approximately 3.22 cm. If the radome losses at this power and wavelength are approximately 4 dB and approximately 2 dB for vertical and horizontal channels, respectively, and with an IF filter loss of 2.2 dB, the radar constant is approximately $3.49*10^7$ $mm^6$ $m^{-3}$ km 2 $mW^{-1}$. Therefore, for a −15.6 dBZ level target positioned at 50 km, an input received power sensitivity may be approximately −127.0 dBm. Because the system (60) may operate with longer pulse widths at lower power, which is less hazardous, the system (60) is more environmentally friendly. Thus, the Federal Communications Commission regulations for licensing are less rigorous than for prior art systems.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A multitransmitter RF rotary joint free weather radar system (60) mounted on a base (30) for emitting a first channel first transmitted wave (10) and a second channel first transmitted wave (20), towards an object and receiving a first channel first reflected wave (40) and a second channel first reflected wave (50), from the object, comprising:

(A) an antenna pedestal (100) having a platform support (110), a platform (120), an azimuth control system (152), and an elevation control system (132), wherein the platform support (110) is attached to the base (30), and the platform (120) is rotatably coupled to the platform support (110), whereby the azimuth control system (152) positions the platform (120) and the azimuth control system (152) generates an azimuth position signal (156) to indicate the position of the platform (120) at the emission of the first channel first transmitted wave (10) and the second channel first transmitted wave (20) and at the receipt of the first channel first reflected wave (40), and the second channel first reflected wave (50);

(B) a reflector (200) having a capture surface (210) and an orthomode feed horn (220), wherein the reflector (200) rotates with the platform (120), whereby the elevation control system (132) positions the reflector (200) and the elevation control system (132) generates an elevation position signal (136), and the orthomode feed horn (220) directs the first channel first transmitted wave (10) and the second channel first transmitted wave (20) to the reflector (200), the reflector (200) reflects the first channel first transmitted wave (10) and the second channel first transmitted wave (20) toward the object, and the capture surface (210) focuses the first channel first reflected wave (40) and the second channel first reflected wave (50) to the orthomode feed horn (220);

(C) a coherent transmitter subsystem (300), wherein the coherent transmitter subsystem (300) rotates with the platform (120), whereby the coherent transmitter subsystem (300) generates a first radio signal (310), a second radio signal (320), and a reference radio signal (330);

(D) a first channel subsystem (400) having:

(i) a first channel transmitter (410) in electromagnetic communication with the coherent transmitter subsystem (300), whereby the first channel transmitter (410) receives the first radio signal (310) from the coherent transmitter subsystem (300) and the first channel transmitter (410) modulates the first radio signal (310) to produce the first channel first transmitted wave (10);

(ii) a first channel power monitor (420) in electromagnetic communication with the first channel transmitter (410), whereby the first channel power monitor (420) allows sampling of the first channel first transmitted wave (10) for analysis;

(iii) a first channel circulator (430) in electromagnetic communication with both the first channel power monitor (420) and the orthomode feed horn (220), whereby the first channel circulator (430) directs the first channel first transmitted wave (10) toward the orthomode feed horn (220);

(iv) a first channel TR limiter (440) in electromagnetic communication with the first channel circulator (430), whereby the orthomode feed horn (220) receives the first channel reflected wave (40) from the reflector (200), the first channel circulator (430) directs the first channel first reflected wave (40) toward the first channel TR limiter (440), and the first channel TR limiter (440) allows passage of the first channel first reflected wave (40) but blocks passage of the first channel first transmitted wave (10); and (v) a first channel receiver (450) in electromagnetic communication with the first channel TR limiter (440), whereby the first channel receiver (450) converts the first channel first reflected wave (40) into a first received wave (452), wherein the first channel subsystem (400) rotates with the platform (120);

(E) a second channel subsystem (500) having:

(i) a second channel transmitter (510) in electromagnetic communication with the coherent transmitter subsystem (300), whereby the second channel transmitter (510) receives the second radio signal (320) and the second channel transmitter (510) modulates the second radio signal (320) to produce the second channel first transmitted wave (20);

(ii) a second channel power monitor (520) in electromagnetic communication with the second channel transmitter (510), whereby the second channel power monitor (520) allows sampling of the second channel first transmitted wave (20) for analysis;

(iii) a second channel circulator (530) in electromagnetic communication with both the second channel power monitor (520) and the orthomode feed horn (220), whereby the second channel circulator (530) directs the second channel first transmitted wave (20) toward the orthomode feed horn (220);

(iv) a second channel TR limiter (540) in electromagnetic communication with the second channel circulator (530), whereby the orthomode feed horn (220) receives the second channel first reflected wave (50) from the reflector (200), the second channel circulator (530) directs the second channel first reflected wave (50) to the second channel TR limiter (540), and the second channel TR limiter (540) allows passage of the second channel first reflected wave (50) but blocks passage of the second channel first transmitted wave (20); and (v) a second channel receiver (550) in electromagnetic communication with the second channel TR limiter (540), whereby the second channel receiver (550) converts the second channel first reflected wave (50) into a second received wave (552), wherein the second channel subsystem (500) rotates with the platform (120); and (F) an analyzer subsystem (600), wherein the analyzer subsystem (600) is in electrical communication with the azimuth control system (152), the elevation control system (132), the first channel receiver (450), the second channel receiver (550), and the coherent transmitter subsystem (300), whereby the analyzer subsystem (600) receives the azimuth position signal (156), the elevation position signal (136), first received wave (452), the second received wave (552), and the reference radio signal (330), and the analyzer subsystem (600) compares the reference radio signal (330), the first channel first transmitted wave (10), the second channel first transmitted wave (20), the first received wave (452), and the second received wave (552) for the azimuth position signal (156) and the elevation position signal (136) and calculates a position of the object.

2. The multitransmitter RF rotary joint free weather radar system (60) of claim 1, wherein the first channel first transmitted wave (10) has a first channel first transmitted wave frequency and the second channel first transmitted wave (20) has a second channel first transmitted wave frequency, and the first channel first transmitted wave frequency is different from the second channel first transmitted wave frequency.

3. The multitransmitter RF rotary joint free weather radar system (60) of claim 2, wherein the first channel subsystem (400) emits a first channel second transmitted wave (12) and the second channel subsystem (500) emits a second channel second transmitted wave (22), wherein the first channel second transmitted wave (12) has a first channel second transmitted wave frequency that is different from the first channel first transmitted wave frequency, and the second channel second transmitted wave (22) has a second channel second transmitted wave frequency that is different from the second channel first transmitted wave frequency.

4. The multitransmitter RF rotary joint free weather radar system (60) of claim 1, wherein the first channel first transmitted wave (10) has a first channel first transmitted wave phase and the second channel first transmitted wave (20) has a second channel first transmitted wave phase, and the first channel first transmitted wave phase is different from the second channel first transmitted wave phase.

5. The multitransmitter RF rotary joint free weather radar system (60) of claim 4, wherein the first channel subsystem (400) emits a first channel second transmitted wave (12) and the second channel subsystem (500) emits a second channel second transmitted wave (22), wherein the first channel second transmitted wave (12) has a first channel second transmitted wave phase that is different from the first channel first transmitted wave phase, and the second channel second transmitted wave (22) has a second channel second transmitted wave phase that is different from the second channel first transmitted wave phase.

6. The multitransmitter RF rotary joint free weather radar system (60) of claim 1, wherein the first channel transmitter (410) is a first traveling wave tube amplifier (412) and the second channel transmitter (510) is a second traveling wave tube amplifier (512).

7. The multitransmitter RF rotary joint free weather radar system (60) of claim 6, wherein the first traveling wave tube amplifier (412) and the second traveling wave tube amplifier (512) are grid-pulsed traveling wave tube amplifiers.

8. The multitransmitter RF rotary joint free weather radar system (60) of claim 1, wherein the first channel transmitter (410) and the second channel transmitter (510) are solid state amplifiers.

9. The multitransmitter RF rotary joint free weather radar system (60) of claim 1, wherein the first channel TR limiter (450) and the second channel TR limiter (550) are high-speed solid-state diode switches.

10. The multitransmitter RF rotary joint free weather radar system (60) of claim 1, wherein the first channel subsystem (400) emits the first channel first transmitted wave (10) substantially simultaneously with the emission of the second channel first transmitted wave (20) from the second channel subsystem (500).

11. The multitransmitter RF rotary joint free weather radar system (60) of claim 1, wherein the first channel first transmitted wave (10) has a first channel first transmitted wave angle of polarization and the second channel first transmitted wave (20) has a second channel first transmitted wave angle of polarization, such that a polarization differential angle measured between the first channel first transmitted wave angle of polarization and the second channel second transmitted wave angle of polarization is approximately ninety degrees.

12. The multitransmitter RF rotary joint free weather radar system (60) of claim 1, wherein the first channel first transmitted wave (10) has a first channel first transmitted wave frequency of between approximately 3 GHz and approximately 35 GHz, and the second channel first transmitted wave (20) has a second channel first transmitted wave frequency of between approximately 3 GHz and approximately 35 GHz.

13. The multitransmitter RF rotary joint free weather radar system (60) of claim 1, wherein the platform (120) has a platform base (150) having a sinistral side (130) and a dextral side (140), wherein the sinistral side (130) and the dextral side (140) extend from the platform base (150);

an azimuth axis of rotation (160) that extends through the platform base (150) to the platform support (110), wherein the platform (120) is rotatably coupled to the platform support (110) with the sinistral side (130) and dextral side (140) substantially parallel to the azimuth axis of rotation (160), whereby the platform (120) rotates around the azimuth axis of rotation (160); and an elevation axis of rotation (170) that extends from the sinistral side (130) to the dextral side (140) substantially parallel to the platform base (150), wherein the first channel subsystem (400) and the second channel subsystem (500) are rigidly coupled to the orthomode feed horn (220) such that the first channel subsystem (400), the second channel subsystem (500), and the orthomode feed horn (220) rotate about the elevation axis of rotation (170), such that a weight of the reflector (200) is counterbalanced in part by a weight of the first channel subsystem (400) and a weight of the second channel subsystem (500) across the elevation axis of rotation (170), whereby the reflector (200), the first channel subsystem (400), and the second channel subsystem (500) move in unison.

14. The multitransmitter RF rotary joint free weather radar system (60) of claim 1, wherein the analyzer subsystem (600) further includes:

an IF digitizer (610);

a system controller (620) in electromagnetic communication with the IF digitizer (610), a data transmitter (630) in electrical communication with the system controller (620), a remote computer system (800) in wireless communication through a wireless link (632) with the data transmitter (630), whereby (i) the IF digitizer (610) receives the first received wave (452) from the first channel subsystem (400), the second received wave (552) from the second channel subsystem (500), and the reference radio signal (330) from the coherent transmitter subsystem (300);

(ii) the IF digitizer (610) converts the first received wave (452), the second received wave (552), and the reference radio signal (330) to a readable format (612) for the system controller (620);

(iii) the system controller (620) compares the readable format (612) for the azimuth position signal (156) and the elevation position signal (136) and calculates a position of the object; and (iv) the system controller (620) outputs a plurality of data (622) to a data transmitter (630) which transfers the data (622) to the remote computer system (800).

15. The multitransmitter RF rotary joint free weather radar system (60) of claim 1, wherein the analyzer subsystem (600) rotates with the platform (120) and the analyzer subsystem (600) is in wireless communication with a remote computer system (800).

16. A multitransmitter RF rotary joint free weather radar system (60) mounted on a base (30) for emitting a first channel first transmitted wave (10), having a first channel first transmitted wave frequency, and a second channel first transmitted wave (20), having a second channel first transmitted wave frequency, towards an object and receiving a first channel first reflected wave (40) and a second channel first reflected wave (50), from the object, comprising:

(A) an antenna pedestal (100) having a platform support (110), a platform (120), an azimuth control system (152), and an elevation control system (132), wherein the platform support (110) is attached to the base (30), and the platform (120) is rotatably coupled to the platform support (110), whereby the azimuth control system (152) positions the platform (120), and the azimuth control system (152) generates an azimuth position signal (156) to indicate the position of the platform (120) at the emission of the first channel first transmitted wave (10) and the second channel first transmitted wave (20) and at the receipt of the first channel first reflected wave (40), and the second channel first reflected wave (50);

(B) a reflector (200) having a capture surface (210) and an orthomode feed horn (220), wherein the reflector (200) rotates with the platform (120), whereby the elevation control system (132) positions the reflector (200) and generates an elevation position signal (136) such that the orthomode feed horn (220) directs the first channel first transmitted wave (10) and the second channel first transmitted wave (20) to the reflector (200), the reflector (200) reflects the first channel first transmitted wave (10) and the second channel first transmitted wave (20) toward the object, and the capture surface (210) focuses the first channel first reflected wave (40) and the second channel first reflected wave (50) to the orthomode feed horn (220);

(C) a coherent transmitter subsystem (300), wherein the coherent transmitter subsystem (300) rotates with the platform (120), whereby the coherent transmitter subsystem (300) generates a first radio signal (310), a second radio signal (320), and a reference radio signal (330);

(D) a first channel subsystem (400) having:

(i) a first traveling wave tube amplifier (412) in electromagnetic communication with the coherent transmitter subsystem (300), whereby the first traveling wave tube amplifier (412) receives the first radio signal (310) from the coherent transmitter subsystem (300) and the first traveling wave tube amplifier (412) modulates the first radio signal (310) to produce the first channel first transmitted wave (10) having the first channel first transmitted wave frequency of between approximately 3 GHz and approximately 35 GHz;

(ii) a first channel power monitor (420) in electromagnetic communication with the first traveling wave tube amplifier (412), whereby the first channel power monitor (420) allows sampling of the first channel first transmitted wave (10) for analysis;

(iii) a first channel circulator (430) in electromagnetic communication with both the first channel power monitor (420) and the orthomode feed horn (220), whereby the first channel circulator (430) directs the first channel first transmitted wave (10) toward the orthomode feed horn (220);

(iv) a first channel TR limiter (440) in electromagnetic communication with the first channel circulator (430), wherein the first channel TR limiter (440) is a high-speed solid-state diode switch, whereby the orthomode feed horn (220) receives the first channel reflected wave (40) from the reflector (200), the first channel circulator (430) directs the first channel first reflected wave (40) toward the first channel TR limiter (440), and the first channel TR limiter (440) allows passage of the first channel first reflected wave (40) but blocks passage of the first channel first transmitted wave (10); and (v) a first channel receiver (450) in electromagnetic communication with the first channel TR limiter (440), whereby the first channel receiver (450) converts the first channel first reflected wave (40) into a first received wave (452), wherein the first channel subsystem (400) rotates with the platform (120);

(E) a second channel subsystem (500) having:

(i) a second traveling wave tube amplifier (512) in electromagnetic communication with the coherent transmitter subsystem (300), whereby the second traveling wave tube amplifier (512) receives the second radio signal (320) and the second traveling wave tube amplifier (512) modulates the second radio signal (320) to produce the second channel first transmitted wave (20) having the second channel first transmitted wave frequency of between approximately 3 GHz and approximately 35 GHz, and the second channel first transmitted wave frequency is different from the first channel first transmitted wave frequency;

(ii) a second channel power monitor (520) in electromagnetic communication with the second traveling wave tube amplifier (512), whereby the second channel power monitor (520) allows sampling of the second channel first transmitted wave (20) for analysis;

(iii) a second channel circulator (530) in electromagnetic communication with both the second channel power monitor (520) and the orthomode feed horn (220), whereby the second channel circulator (530) directs the second channel first transmitted wave (20) toward the orthomode feed horn (220);

(iv) a second channel TR limiter (540) in electromagnetic communication with the second channel circulator (530), wherein the second channel TR limiter (540) is a high-speed solid-state switch, whereby the orthomode feed horn (220) receives the second channel first reflected wave (50) from the reflector (200), the second channel circulator (530) directs the second channel first reflected wave (50) to the second channel TR limiter (540), and the second channel TR limiter (540) allows passage of the second channel first reflected wave (50) but blocks passage of the second channel first transmitted wave (20); and (v) a second channel receiver (550) in electromagnetic communication with the second channel TR limiter (540), whereby the second channel receiver (550) converts the second channel first reflected wave (50) into a second received wave (552), wherein the second channel subsystem (500) rotates with the platform (120); and (F) an analyzer subsystem (600), wherein the analyzer subsystem (600) is in communication with the azimuth control system (152), the elevation control system (132), the first channel receiver (450), the second channel receiver (550), and the coherent transmitter subsystem (300) and the analyzer subsystem (600), whereby the analyzer subsystem (600) receives the azimuth position signal (156), the elevation position signal (136), first received wave (452), the second received wave (552), and the reference radio signal (330), and the analyzer subsystem (600) compares the reference radio signal (330), the first received wave (452), and the second received wave (552) for the azimuth position signal (156) and the elevation position signal (136) and calculates a position of the object, a reflectivity differential, and a phase differential.

17. The multitransmitter RF rotary joint free weather radar system (60) of claim 16, wherein the first channel subsystem (400) emits a first channel second transmitted wave (12) and the second channel subsystem (500) emits a second channel second transmitted wave (22), wherein the first channel second transmitted wave (12) has a first channel second transmitted wave frequency that is different from the first channel first transmitted wave frequency, and the second channel second transmitted wave (22) has a second channel second transmitted wave frequency that is different from the second channel first transmitted wave frequency.

18. The multitransmitter RF rotary joint free weather radar system (60) of claim 16, wherein the platform (120) has a platform base (150) having a sinistral side (130) and a dextral side (140), wherein the sinistral side (130) and the dextral side (140) extend from the platform base (150);

an azimuth axis of rotation (160) that extends through the platform base (150) to the platform support (110), wherein the platform (120) is rotatably coupled to the platform support (110) with the sinistral side (130) and dextral side (140) substantially parallel to the azimuth axis of rotation (160), whereby the platform (120) rotates around the azimuth axis of rotation (160); and an elevation axis of rotation (170) that extends from the sinistral side (130) to the dextral side (140) substantially parallel to the platform base (150), wherein the first channel subsystem (400) and the second channel subsystem (500) are rigidly coupled to the orthomode feed horn (220) such that the first channel subsystem (400), the second channel subsystem (500) and the orthomode feed horn (220) rotate about the elevation axis of rotation (170), such that a weight of the reflector (200) is counterbalanced in part by a weight of the first channel subsystem (400) and a weight of the second channel subsystem (500) across the elevation axis of rotation (170), whereby the reflector (200), the first channel subsystem (400), and the second channel subsystem (500) move in unison.

19. The multitransmitter RF rotary joint free weather radar system (60) of claim 16, wherein the first channel first transmitted wave (10) has a first channel first transmitted wave phase and the second channel first transmitted wave (20) has a second channel first transmitted wave phase, and the first channel first transmitted wave phase is different from the second channel first transmitted wave phase.

20. The multitransmitter RF rotary joint free weather radar system (60) of claim 16, wherein the first channel first transmitted wave (10) has a first channel first transmitted wave polarization and the second channel first transmitted wave (20) has a second channel first transmitted wave polarization, and the first channel first transmitted wave polarization is different from the second channel first transmitted wave polarization.

21. The multitransmitter RF rotary joint free weather radar system (60) of claim 16, wherein the analyzer subsystem (600) rotates with the platform (120) and the analyzer subsystem (600) is in wireless communication with a remote computer system (800).

22. The multitransmitter RF rotary joint free weather radar system (60) of claim 16, wherein the analyzer subsystem (600) further includes:

an IF digitizer (610);

a system controller (620) in electromagnetic communication with the IF digitizer (610), a data transmitter (630) in electrical communication with the system controller (620), a remote computer system (800) in wireless communication through a wireless link (632) with the data transmitter (630), whereby (i) the IF digitizer (610) receives the first received wave (452) from the first channel subsystem (400), the second received wave (552) from the second channel subsystem (500), and the reference radio signal (330) from the coherent transmitter subsystem (300);

(ii) the IF digitizer (610) converts the first received wave (452), the second received wave (552), and the reference radio signal (330) to a readable format (612) for the system controller (620);

(iii) the system controller (620) compares the readable format (612) for the azimuth position signal (156) and the elevation position signal (136) and calculates a position of the object; and (iv) the system controller (620) outputs a plurality of data (622) to a data transmitter (630) which transfers the data (622) to the remote computer system (800).

23. A multitransmitter RF rotary joint free weather radar system (60) mounted on a base (30) for emitting a first channel first transmitted wave (10), having a first channel first transmitted wave frequency and a first channel first transmitted wave phase, and a second channel first transmitted wave (20), having a second channel first transmitted wave frequency and a second channel first transmitted wave phase, towards an object and receiving a first channel first reflected wave (40) and a second channel first reflected wave (50), from the object, comprising:

(A) an antenna pedestal (100) having a platform support (110) and a platform (120) wherein the platform support (110) is attached to the base (30), and wherein the platform (120) has (i) a platform base (150) having a sinistral side (130) and a dextral side (140), wherein the sinistral side (130) and dextral side (140) extend from the platform base (150);

(ii) an azimuth axis of rotation (160) that extends through the platform base (150) to the platform support (110), wherein the platform (120) is rotatably coupled to the platform support (110) with the sinistral side (130) and dextral side (140) substantially parallel to the azimuth axis of rotation (160), whereby the platform (120) rotates around the azimuth axis of rotation (160); and (iii) an elevation axis of rotation (170) that extends from the sinistral side (130) to the dextral side (140) substantially parallel to the platform base (150);

(B) a reflector (200) having a capture surface (210) and an orthomode feed horn (220), wherein the reflector (200) rotates with the platform (120), whereby the azimuth control system (152) and the elevation control system (132) coordinate positioning of the reflector (200) and the azimuth control system (152) generates an azimuth position signal (156) and the elevation control system (132) generates an elevation position signal (136) to indicate the position of the reflector (200) at the emission of the first channel first transmitted wave (10), the second channel first transmitted wave (20), and the orthomode feed horn (220) directs the first channel first transmitted wave (10) and the second channel first transmitted wave (20) to the reflector (200), the reflector (200) reflects the first channel first transmitted wave (10) and the second channel first transmitted wave (20) toward the object, and the capture surface (210) focuses the first channel first reflected wave (40) and the second channel first reflected wave (50) to the orthomode feed horn (220);

(C) a coherent transmitter subsystem (300), wherein the coherent transmitter subsystem (300) rotates with the platform (120), whereby the coherent transmitter subsystem (300) generates a first radio signal (310), a second radio signal (320), and a reference radio signal (330);

(D) a first channel subsystem (400) having:

(i) a first traveling wave tube amplifier (412) in electromagnetic communication with the coherent transmitter subsystem (300), whereby the first traveling wave tube amplifier (412) receives the first radio signal (310) from the coherent transmitter subsystem (300) and the first traveling wave tube amplifier (412) modulates the first radio signal (310) to produce the first channel first transmitted wave (10) having the first channel first transmitted wave frequency of between approximately 3 GHz and approximately 35 GHz;

(ii) a first channel power monitor (420) in electromagnetic communication with the first traveling wave tube amplifier (412), whereby the first channel power monitor (420) allows sampling of the first channel first transmitted wave (10) for analysis;

(iii) a first channel circulator (430) in electromagnetic communication with both the first channel power monitor (420) and the orthomode feed horn (220), whereby the first channel circulator (430) directs the first channel first transmitted wave (10) toward the orthomode feed horn (220);

(iv) a first channel TR limiter (440) in electromagnetic communication with the first channel circulator (430), wherein the first channel TR limiter (440) is a high-speed solid-state diode switch, whereby the orthomode feed horn (220) receives the first channel reflected wave (40) from the reflector (200), the first channel circulator (430) directs the first channel first reflected wave (40) toward the first channel TR limiter (440), and the first channel TR limiter (440) allows passage of the first channel first reflected wave (40) but blocks passage of the first channel first transmitted wave (10); and (v) a first channel receiver (450) in electromagnetic communication with the first channel TR limiter (440), whereby the first channel receiver (450) converts the first channel first reflected wave (40) into a first received wave (452);

(E) a second channel subsystem (500) having:

(i) a second traveling wave tube amplifier (512) in electromagnetic communication with the coherent transmitter subsystem (300), whereby the second traveling wave tube amplifier (512) receives the second radio signal (320) and the second traveling wave tube amplifier (512) modulates the second radio signal (320) to produce the second channel first transmitted wave (20) having the second channel first transmitted wave frequency of between approximately 3 GHz and approximately 35 GHz and the second channel first transmitted wave frequency is different from the first channel first transmitted wave frequency and the first channel first transmitted wave phase is different from the second channel first transmitted wave phase;

to (ii) a second channel power monitor (520) in electromagnetic communication with the second traveling wave tube amplifier (512), whereby the second channel power monitor (520) allows sampling of the second channel first transmitted wave (20) for analysis;

(iii) a second channel circulator (530) in electromagnetic communication with both the second channel power monitor (520) and the orthomode feed horn (220), whereby the second channel circulator (530) directs the second channel first transmitted wave (20) toward the orthomode feed horn (220);

(iv) a second channel TR limiter (540) in electromagnetic communication with the second channel circulator (530), wherein the second channel TR limiter (540) is a high-speed solid-state switch, whereby the orthomode feed horn (220) receives the second channel first reflected wave (50) from the reflector (200), the second channel circulator (530) directs the second channel first reflected wave (50) to the second channel TR limiter (540), and the second channel TR limiter (540) allows passage of the second channel first reflected wave (50) but blocks passage of the second channel first transmitted wave (20); and (v) a second channel receiver (550) in electromagnetic communication with the second channel TR limiter (540), whereby the second channel receiver (550) converts the second channel first reflected wave (50) into a second received wave (552), wherein the first channel subsystem (400) and the second channel subsystem (500) are rigidly coupled to the orthomode feed horn (220) such that the first channel subsystem (400), the second channel subsystem (500) and the orthomode feed horn (220) rotate about the elevation axis of rotation (170), such that a weight of the reflector (200) is counterbalanced in part by a weight of the first channel subsystem (400) and a weight of the second channel subsystem (500) across the elevation axis of rotation (170), whereby the reflector (200), the first channel subsystem (400), and the second channel subsystem (500) move in unison; and (F) an analyzer subsystem (600) having:

(i) an IF digitizer (610);

(ii) a system controller (620) in electromagnetic communication with the IF digitizer (610), (iii) a data transmitter (630) in electrical communication with the system controller (620), and (iv) a remote computer system (800) in wireless communication through a wireless link (632) with the data transmitter (630), whereby (a) the IF digitizer (610) receives the first received wave (452) from the first channel subsystem (400), the second received wave (552) from the second channel subsystem (500), and the reference radio signal (330) from the coherent transmitter subsystem (300); (b) the IF digitizer (610) converts the first received wave (452), the second received wave (552), and the reference radio signal (330) to a readable format (612) for the system controller (620); (c) the system controller (620) compares the readable format (612) for the azimuth position signal (156) and the elevation position signal (136) and calculates a position of the object; and (d) the system controller (620) outputs a plurality of data (622) to a data transmitter (630) which transfers the data (622) to the remote computer system (800).

* * * * *